United States Patent [19]

Pellegrino

[11] 4,111,419

[45] Sep. 5, 1978

[54] PRACTICE HOCKEY PUCK

[76] Inventor: Peter P. Pellegrino, 2935 Border Links Rd., Visalia, Calif. 93277

[21] Appl. No.: 708,533

[22] Filed: Jul. 26, 1976

[51] Int. Cl.[2] ..... A63B 69/00; A63B 59/14

[52] U.S. Cl. ..... 273/1 B; 273/67 A; 273/128 R; 273/128 A

[58] Field of Search ..... 273/1 B, 128 R, 128 A, 273/58 C, 67 A

[56] References Cited

U.S. PATENT DOCUMENTS

| | | | |
|---|---|---|---|
| 801,145 | 10/1905 | Feltner | 273/58 C |
| 3,467,386 | 9/1969 | Smith | 273/128 R X |
| 3,704,891 | 12/1972 | Chiarelli | 273/128 R |
| 3,784,204 | 1/1974 | Felber | 273/128 R |
| 3,863,917 | 2/1975 | Beale | 273/1 B |
| 3,889,945 | 6/1975 | Ellis | 273/128 R X |

FOREIGN PATENT DOCUMENTS

| | | | |
|---|---|---|---|
| 176,164 | 3/1922 | United Kingdom | 273/128 R |

*Primary Examiner*—Paul E. Shapiro

*Attorney, Agent, or Firm*—Blakely, Sokoloff, Taylor & Zafman

[57] ABSTRACT

A practice hockey puck for use in individual practice on surfaces other than ice. The practice hockey puck body may be a standard hockey puck altered so as to have a plurality of headed pins disposed about the periphery of the two flat surfaces thereon. Headed members are also provided at the center of the two flat surfaces, with the heads thereof extending above the elevation of the heads of the members at the periphery of the flat surfaces so that the majority of the weight of the hockey puck is supported on these central members when resting on a flat surface. The puck is removably coupled to an elastic cord which in turn includes a fastening device at the opposite end thereof for fastening to a hockey stick. One section of the elastic cord may be provided with known and limited breakage characteristics so as to limit the maximum elastic energy which may be stored in the elastic cord to limit the springback of the puck.

8 Claims, 7 Drawing Figures

Fig. 1
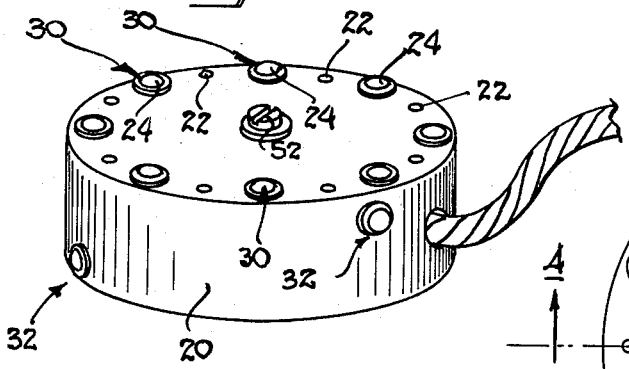
Fig. 2
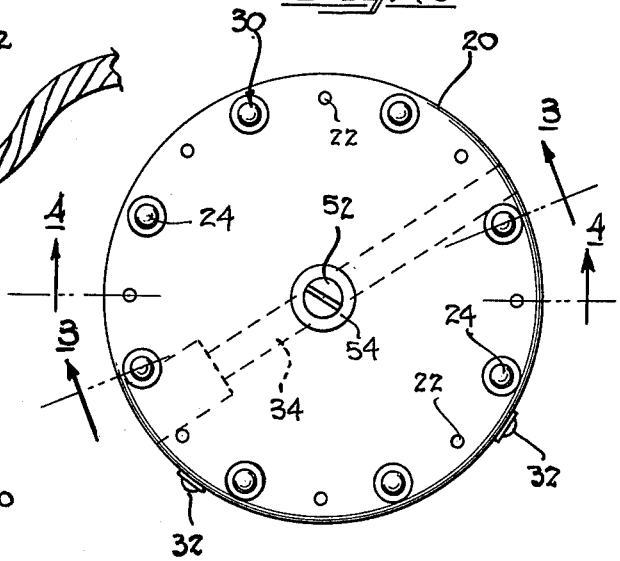
Fig. 3
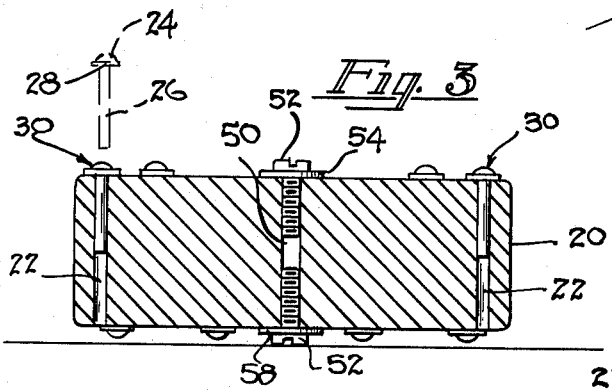
Fig. 4
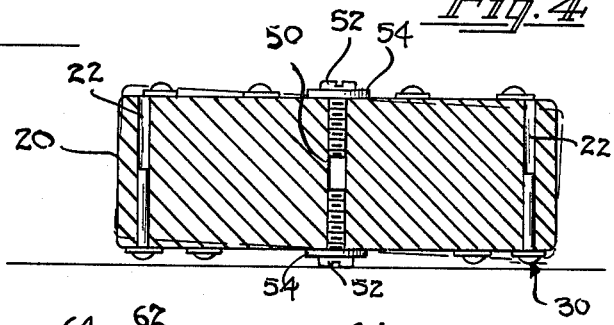
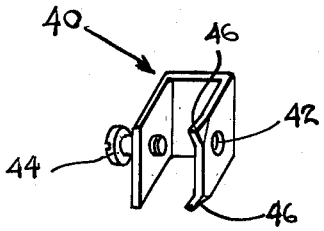
Fig. 7
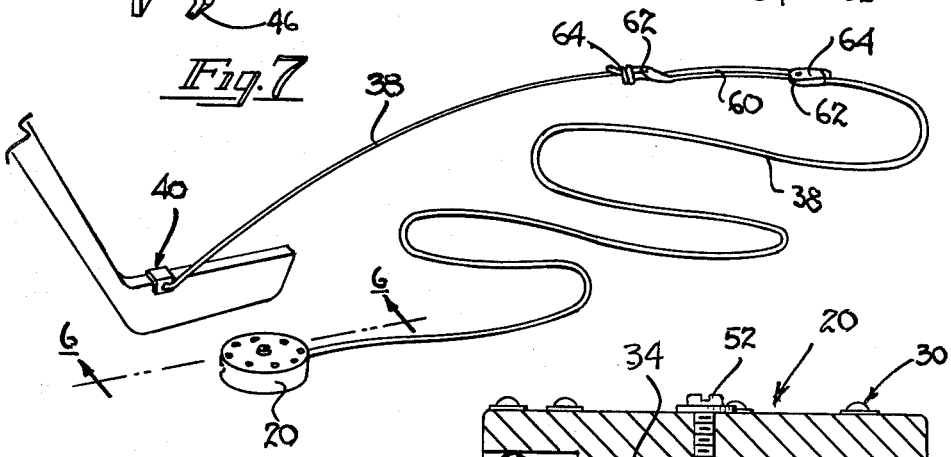
Fig. 5
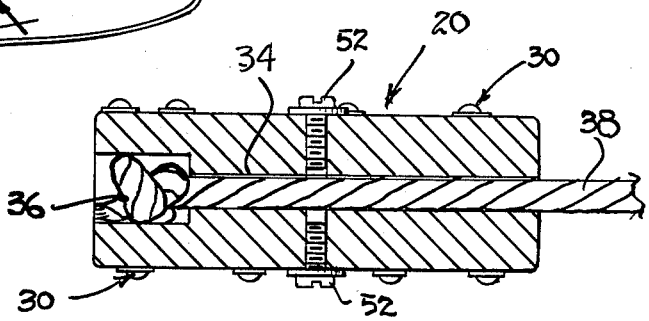
Fig. 6

PRACTICE HOCKEY PUCK

BACKGROUND OF THE INVENTION

1. Field of the Invention

This invention relates to the field of sports equipment, and more particularly to equipment for individual practice of hockey shots.

2. Prior Art

In recent years hocky has become an increasingly popular sport in the United States. While the sport is theoretically condusive to outdoor play in the colder regions of the country, the sport in fact is almost always played on artificial ice on indoor rinks specially set up for this purpose, or at least specially marked off as a regulation hockey rink. Even in the colder portions of the country, suitable outdoor rinks are not frequently provided. Natural ice over ponds and the like is generally of low quality and relatively inaccessible, and duration during which natural ice or freezing of outdoor rinks is satisfactory is erratic and highly limited, except perhaps in the most northern areas of the country. Accordingly, both practice and play for ice hockey is confined to indoor rinks of artificial ice which have been set up for this purpose.

It should be noted that many popular sports have very few special requirements with respect to the field or court on which they are played, and accordingly may be practiced and even played almost anywhere. Baseball and football by way of example, require only reasonably level ground for highly beneficial practice with a single field often serving at different times as a field for football, baseball, soccer and track. Basketball may be played on any relatively hard surface by appropriate disposition of the basket and backboard with respect thereto, with both indoor and outdoor locations being used. Ice hockey, on the other hand, has far more limiting requirements with respect to the area in which it may be either played or practiced. The puck is relatively small (approximately 3 inches in diameter) though is quite dense and relatively heavy (approximately 6 ounces). One aspect of the sport is the propulsion of the puck at a high velocity, hopefully in a controlled manner by the hockey stick, with the result that the forces resulting on impact of the puck with an obstacle are very high. Thus the practice or play of the game presents a hazard to unprotected bystanders, and may do substantial damage to windows and the like in an indoor rink unless the rink is specifically set up to be protected against such dangers. Consequently, both practice and play on skating rinks must generally be limited to specific times set aside exclusively for this purpose.

Because of the foregoing limiting requirements on the space used, even for the practice of ice hockey, and the increasing popularity of the sport, there is a great need for some suitable and practical method and apparatus for practicing typical shots used in the play of the game. Any method and apparatus used should reasonably accurately duplicate the characteristics of the puck on ice, and preferably should allow a relatively large number of shots in a reasonable time in a reasonable space so as to provide concentrated, realistic and beneficial practice. In the prior art no apparatus is known for this purpose. Instead it is relatively common to practice using a conventional hockey stick and puck on parking lot surfaces and the like, a less than ideal substitute for a real ice hockey rink. A hockey puck on surfaces of this type experiences considerable friction, thereby not responding as a puck on ice responds, and resulting in relatively rapid deterioration of the puck. If a particular shot encourages the puck onto its side into a rolling motion, the puck may roll for great distances to the frustration and fatigue of the individual attempting to practice. Even without rolling, the distance traveled by the puck during a practice shot would be sufficient to grossly limit the extent of practice that may be achieved in a reasonable time.

BRIEF SUMMARY OF THE INVENTION

A practice hockey puck for use in individual practice on surfaces other than ice. The practice hockey puck body may be a standard hockey puck altered so as to have a plurality of headed pins disposed about the periphery of the two flat surfaces thereon. Headed members are also provided at the center of the two flat surfaces, with the heads thereof extending above the elevation of the heads of the members at the periphery of the flat surfaces so that the majority of the weight of the hockey puck is supported on these central members when resting on a flat surface. The puck is removably coupled to an elastic cord which in turn includes a fastening device at the opposite end thereof for fastening to a hockey stick. One section of the elastic cord may be provided with known and limited breakage characteristics so as to limit the maximum elastic energy which may be stored in the elastic cord to limit the springback of the puck.

This section of known or preselected breakage characteristics may be an elastic section, or in the alternative may be substantially nonelastic, as the overall elasticity of the cord will be provided by the remaining sections thereof. Also as an alternative any form of metal wear resistant member may be mounted to the puck by some form of shank for the protection of the puck body from the generally corase and abrasive surfaces on which the present invention is intended to be used.

BRIEF DESCRIPTION OF THE DRAWINGS

FIG. 1 is a perspective view of the puck of the present invention.

FIG. 2 is a top view of the puck of FIG. 1.

FIGS. 3 and 4 are cross-sectional views taken along lines 3 and 4 of FIG. 2, respectively.

FIG. 5 is a perspective view of the entire practice puck assembly of the present invention.

FIG. 6 is a cross-sectional view taken along line 6—6 of FIG. 5.

FIG. 7 is a perspective view of the fastening means for clamping one end of the elastic cord to a standard hockey stick.

DETAILED DESCRIPTION OF THE INVENTION

Having now generally described the general functions and features of the present invention, the preferred embodiment will now be described. First referring to FIG. 1, a hockey puck body 20 having a plurality of holes and attachments thereto may be seen. The body 20 in the preferred embodiment is a standard hockey puck thereby being of hard rubber approximately 1 inch thick and 3 inches in diameter. In this standard body are provided a plurality of through holes 22, substantially equally spaced around the periphery of the body, with metal members 30 having heads 24 being pressed into the holes 22. As may be seen in FIG. 3, these metal members in this embodiment have a cylindrical shank 26 having a press fit into the holes 22, with a washer 28 being disposed under the head 24 of each metal member so as to better space the head away from the body 20 and to generally resist the further penetration of the metal members into the puck body. As shall subsequently be seen, useage of the practice puck of the present invention on surfaces such as concrete driveways, parking lots, etc. results in progressive wear of the heads 24, eventually clearly visibly displaying such wear by the fact that the washer has slipped over the badly worn head and is missing.

As is suggested in FIGS. 1 through 4, in this embodiment the metal members generally, indicated by the numeral 30, are disposed in every other hole at the periphery of the top and bottom surfaces, and are staggered with respect thereto so that only one metal member is disposed in each hole. This allows better retention of the metal members by allowing penetration of the shank of the metal members more than one-half way through the body. This in combination with the through-hole has the further advantage of allowing the pressing out of the shanks 26 of the metal members from the opposite face of the body member, thereby assuring easy extraction, even if the head and protruding shank portion are substantially worn away.

It will be also noted in these FIGURES that there are an additional plurality of metal members, generally indicated by the numeral 32, which are inserted into radially disposed holes through the cylindrical side surface of the puck. These additional metal members 32 are identical to the members 30 in the top and bottom surfaces, and are specifically disposed in alternate directions away from the center plane of the puck. The purpose of these additional metal members, which of course may be removed if desired when the puck is being used in the tehtered mode, is to create instabilities in the rolling motion of the puck when used in the untethered mode to limit the possible extent of rolling of the puck.

In the preferred embodiment the various holes in the puck for the receipt of the pins having a press fit therein are precision reamed to a relatively close tolerance, so that the pins are frictionally retained but are not so tight as to hang up under pressure. Thus, when the puck is struck with the stick or strikes a wall, etc. the pins, particularly pins 32, are free to move into the rubber at impact, and equally importantly to retract after impact to the normal press fit position. Thus, the pins will deflect on impact to allow the puck to better absorb the shock, but will return to the desired starting position so as to not premanently deform the puck. The deformation of the puck on impact also serves a second function, that is the tendency to distort the holes retaining the pins not participating in the impact, thereby more firmly grasping the pins to prevent the pins from extending out of or being expelled from the holes. Accordingly, there are definitely desired limits on the tightness or looseness of the pins which is readily achieved by precision holes in the puck body.

The puck body 20 is also provided with a through hole 34 approximately centrally located through the cylindrical side of the puck body (see FIGS. 2 and 6). This through hole allows the passage of an elastic cord 38 therethrough, with retention of a cord with respect to the puck body being provided by a simple knot 36 adjacent one end of the cord. Preferably, the elastic cord is of the general type having an elastic central core with a woven covering thereover, whereby the elastic cord may provide a high degree of elasticity, with the woven covering providing protection for the elastic and a stretch limit so as to prevent damage or breakage by the overstressing of the cord.

Preferably the elastic cord 38 is tied to a small metal member 40, details of which may be seen in FIG. 7. This metal member is characterized by its C-shape, having a through hole 42 on one leg of the C so that one end of the elastic cord 38 may be tied thereto. The opposite leg of the C threadidly receives a locking screw, with the spacing between the two legs of the C-shaped member being such as to just fit over the edge of the standard hockey stick so that it may be locked thereto by the screw 44. If desired, a small back-up plate may be used to avoid any penetration of the end of the screw into the hockey stick. Also, it will be noted that the leg of the C-shaped member having the through hole 42 therein (see FIG. 7) is generally not quite parallel to the opposite leg, but instead the corner regions 46 are bent so that the edges of that leg are substantially parallel to the opposite leg, and so as to define a slight channel or relieved area therebetween for passage of the elastic cord. This assures adequate clamping to the hockey stick and prevents pinching and weakening of the cord at that region.

Now referring particularly to FIGS. 3 and 4 and incidentally also to FIGS. 1, 2 and 6, another feature of the present invention may be seen. In particular, it is noted that the puck body 20 has a centrally disposed through hole 50 extending through the opposite faces of the puck body. Metal members, specifically screws 52, threadedly engage the screw holes, with washers 54 spacing the screws slightly away from the puck body. These screws, it will be noted, extend outward from the planes defined by the tops of metal members 30 so that the practice puck will rest thereon with or without contact of one or more of the metal members 30. Thus, as the practice puck slides along a hard surface such as a driveway or a parking lot, the area of contact with the surface is minimized, thereby minimizing the friction and energy loss which might otherwise be expected with such surfaces. Of course the metal members 30 around the periphery of the practice puck generally prevent the puck body itself from contacting the surface thereunder, so that wear is confined primarily to the heads of the screw members 52 and secondarily to the heads of metal members 30. Also from the foregoing description one of the features of the present invention may readily be illustrated. In particular while the various washers prevent the associated metal members from excessively penetrating the puck body, they also provide a quick visual indication of the condition of the head of the metal members as the wearing away of the head of any of the metal members results in the loss of the washer thereunder, a condition which becomes very visibly apparent..

A further feature of the present invention may be seen in FIG. 5. In particular it will be noted that the elastic cord 38 is split into two sections, with an intermediate joining section 60 coupled therebetween. Each of the sections 38 of the elastic cord are provided with a loop 62 at the end thereof maintained by a small metal clamp 64. Looped between the two loops 62 is the intermediate section 60, which preferably is a simple elastic section not having the woven fabric covering of the elastic cord 38, and in particular having a selected energy absorbing and breakage characteristic. The purpose of this section is to define the maximum energy which may be stored in the entire elastic system beyond which breakage of the readily replaceable section 60 will occur. Such an arrangement prevents a return of a puck shot at an excessive speed, and prevents damage to the remainder of the elastic cord by predeterminally allowing controlled breakage when appropriate. Obviously the section 60 need not be very long, as the majority of the stored energy will normally be stored in the cord sections 38. For that reason, the section 60 does not necessarily have to be an elastic section, as a substantially non-elastic section of chosen breakage characteristics will still limit the overall force and thus the elastic energy stored in cord 38. In the preferred embodiment replacement kits are supplied so that the player may reassemble the cord and resume practice.

There has been described herein a practice hockey puck which will allow concentrated and beneficial practice on surfaces other than ice, such as concrete, asphalt, wood, plastic, rubber, etc. surfaces. The hockey puck is configured so as to be substantially of regulation size and weight, with provisions being made both to minimize wear on such surfaces and to allow quick visual inspection for wear. The puck may be used in a tethered mode by tethering to a standard hockey stick, thereby providing for both a shot and a return shot without requiring any form of stake or other tie-down of the tethering arrangement. Of course the puck may be used for untethered practice and play on such surfaces by simple removal of the puck from the tethering cord, in which case specially disposed members or projections on the cylindrical side of the puck will protect the puck and minimize its tendency to roll. All of the various metal members, of course, which are fastened to the puck are readily removable for replacement, for altering its characteristics on various surfaces, or for use of the basic puck body as a conventional puck on ice. While the preferred embodiment has been disclosed and described in detail herein it will be understood by those skilled in the art that various changes in form and detail may be made therein without departing from the spirit and scope of the invention.

I claim:

1. A practice hockey puck comprising:

a body member having generally flat top and bottom surfaces joined by a cylindrical side surface generally in the form of a hockey puck, said member having a plurality of through holes extending between said top and bottom surfaces adjacent the periphery thereof for receiving and frictionally retaining a plurality of removable metal members; and a plurality of metal members, each of said metal members having a generally cylindrical shank portion for fitting within a respective one of said holes in said top and bottom surfaces, and a head portion of larger diameter than said shank portion for engaging the respective one of said top and bottom surfaces to limit penetration of each of said metal members into said body member, said metal members being disposed in every other hole at the periphery of the top and bottom surfaces, so that only one metal member is disposed in each through hole, each of said metal members being frictionally retained in said holes so that said member may move into said puck member at impact and retract to the normal position after impact.

2. The practice hocky puck of claim 1 further comprised of a plurality of washers, each of said washers being disposed under a respective said head portions of each of said metal members.

3. The practice hockey puck of claim 1 wherein said body member further has holes generally perpendicular to and centrally disposed with respect to said top and bottom surfaces, and further comprised of a top and a bottom metal screw member having a head portion, and a shank portion for fitting within and threadably engaging said body member in said last named holes;

whereby said head portion of said top and bottom screw members may be selectively extended further away from said top and bottom surfaces of said body member, respectively, than said head portions of said plurality of metal members.

4. The hockey puck of claim 3 further comprised of a pair of washers, each of said washers being disposed under the head of a respective one of said screws.

5. A practice hockey puck comprising:

a body member having generally flat top and bottom surfaces joined by a cylindrical side surface generally in the form of a hockey puck, said member having a plurality of holes in said top and bottom surfaces adjacent the periphery thereof and in said cylindrical side surface for receiving and retaining a plurality of metal members, and further having holes centrally disposed through said top and bottom surfaces for receiving additional members;

a plurality of washers;

a plurality of metal members having a shank portion for fitting within a respective one of said holes in said top and bottom surface and said cylindrical surface, and a head portion of larger diameter than said shank portion, said shank portion of each of said metal members passing through at least one of said washers and into a respective one of said holes whereby said head portion of each of the respective metal members may engage a respective one of said washers to limit penetration of each of said metal members into said body member; and top and bottom members of metal having a head portion and a shank portion, each of said top and bottom members of metal having its respective shank portion disposed in one of said centrally disposed holes in said top and bottom surfaces so that the head portion of said top and bottom members extend further away from said top and bottom surfaces of said body member, respectively, than said head portions of said plurality of metal members.

6. A practice hockey puck comprising:

a body member having generally flat top and bottom surfaces joined by a cylindrical side surface generally in the form of a hockey puck, said member having a plurality of holes in said top and bottom surfaces adjacent the periphery thereof and in said cylindrical side surface for receiving and retaining a plurality of metal members; and a plurality of metal members, each of said metal members having a shank portion for fitting within a respective one of said holes in said top and bottom surfaces and in said cylindrical side surface, and a head portion of larger diameter than said shank portion for engaging the respective one of said top and bottom surfaces and said cylindrical side surface to limit penetration of each of said metal members into said body member.

7. The practice hockey puck of claim 6 wherein said body member further has holes generally perpendicular to and centrally disposed with respect to said top and bottom surfaces, and further comprised of a top and bottom member of metal having a head portion, and a shank portion for fitting within said last named holes.

8. The hock puck of claim 6 wherein said holes in said cylindrical side surface are staggered in alternate directions away from the center plane of the puck and having said metal members mounted therein, whereby instabilities in the rolling motion of the puck are created.

* * * * *